US006405002B2

(12) United States Patent
Ogiyama et al.

(10) Patent No.: US 6,405,002 B2
(45) Date of Patent: Jun. 11, 2002

(54) IMAGE FORMATION APPARATUS

(75) Inventors: Hiromi Ogiyama, Tokyo; Toshiharu Hachisuka; Yuji Sawai, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/793,576

(22) Filed: Feb. 27, 2001

(30) Foreign Application Priority Data

Feb. 28, 2000 (JP) ..... 2000-050741

(51) Int. Cl.[7] ..... G03G 15/16; G03G 15/00

(52) U.S. Cl. ..... 399/101; 399/71; 399/302

(58) Field of Search ..... 399/71, 98, 101, 399/297, 302, 308, 349, 353, 354, 357

(56) References Cited

U.S. PATENT DOCUMENTS 5,070,370 A * 12/1991 Bellis ..... 399/101
5,233,394 A * 8/1993 Fujita et al. ..... 399/101
5,600,405 A * 2/1997 Umeda et al. ..... 399/71
5,937,254 A * 8/1999 Maher et al. ..... 399/297
5,991,567 A * 11/1999 Kobayashi et al. ..... 399/101
6,049,681 A * 4/2000 Shiozawa et al. ..... 399/101 X
6,308,019 B1 * 10/2001 Miyashiro et al. ..... 399/101 X

FOREIGN PATENT DOCUMENTS

| | | |
|---|---|---|
| JP | 9-50198 | 2/1997 |
| JP | 10-49023 | 2/1998 |
| JP | 10-254251 | 9/1998 |

* cited by examiner

*Primary Examiner*—Sandra Brase
(74) *Attorney, Agent, or Firm*—Oblon, Spivak, McClelland, Maier & Neustadt, P.C.

(57) ABSTRACT

In an image formation apparatus, a voltage greater than a value, at which toner removal efficiency when a second cleaning device removes toner from an intermediate transfer body is maximum, is applied to a cleaning roller.

12 Claims, 6 Drawing Sheets

IMAGE FORMATION APPARATUS

FIELD OF THE INVENTION

The present invention in general relates to an image formation apparatus. More particularly, this invention relates to an image formation apparatus in which it is possible to effectively remove the unwanted toner from the intermediate transfer body.

BACKGROUND OF THE INVENTION

An image formation apparatus configured as a multifunction machine is conventionally known. Such an image formation apparatus has functions of an electronic copying machine, a printer, and a facsimile, or at least two of the functions. In this type of image formation apparatus, toner images of different colors are primarily transferred superposedly onto its intermediate transfer body. The superposed toner images are then secondarily transferred collectively onto a recording medium, so that a color image can be formed.

Any residual toner existing on the intermediate transfer body, after the toner image is secondarily transferred onto the recording medium, is removed from the surface of the intermediate transfer body using a second cleaning device. This second cleaning device also removes any toner not having received the action by the secondary transfer unit on the intermediate transfer body. For example, when a recording medium is not successfully conveyed due to paper jam or the like during image formation, the operation of the image formation apparatus is stopped. The image forming operation is restarted after the unsuccessfully conveyed recording medium is removed, in other words, after the jammed paper is removed. When restarting the operation, the toner image, that is formed on the intermediate transfer body on the upstream side from a secondary transfer region in the direction of the movement of the intermediate transfer body, passes through the secondary transfer region without receiving the secondary transfer action, and the toner is removed from the surface of the intermediate transfer body by the second cleaning device. The second cleaning device removes not only the residual toner from the intermediate transfer body but also the toner not having received the secondary transfer action from the intermediate transfer body. However, if the efficiency with witch the toner is removed is less, the toner remaining on the intermediate transfer body is stuck on a next recording medium. This fact inevitably degrades the quality of the toner image on the recording medium, and makes background dirt more significant.

Therefore, in the conventional image formation apparatus, a voltage applied to the cleaning member is set as follows. The voltage is set in such a manner that any residual toner remaining on the intermediate transfer body and any toner, which has not received the secondary transfer action, on the intermediate transfer body can be most efficiently removed therefrom by the cleaning member of the second cleaning device. That is, the voltage is set in such a manner that the cleaning efficiency of the cleaning member becomes the highest.

However, there are problems with the above-mentioned method. If the voltage is set in the manner explained above, the small amount of toner remaining on the intermediate transfer body, due to unsatisfactory cleaning by the second cleaning device, is easily transferred onto the next recording medium. Resultantly, background dirt may occur on the next recording medium and the quality of the toner image secondarily transferred onto the recording medium may be degraded.

Another image formation apparatus has been proposed. In this image formation apparatus, a charger is provided on the downstream side from the secondary transfer region where secondary transfer of the toner image is performed in the movement direction of the surface of the intermediate transfer body. As a result, any residual toner on the intermediate transfer body is forcefully charged to a polarity opposite to its normal polarity. The residual toner is then electrostatically shifted to the surface of the image carrier in a primary transfer region where primary transfer of the toner image is executed. The shifted toner is then removed from the surface of the image carrier by a cleaning unit for cleaning the image carrier. This image formation apparatus stops removing the residual toner from the intermediate transfer body by the cleaning unit for the intermediate transfer body, returns all the residual toner to the surface of the image carrier, and removes the toner from the image carrier by the cleaning unit for the image carrier. Thus, the residual toner after secondary transfer deposited on the intermediate transfer body is a small amount. Therefore, it is possible to shift the toner to the image carrier and remove the toner therefrom efficiently by the cleaning unit for the image carrier.

However, according to the proposed image formation apparatus, it is difficult to remove the toner, which has not received the secondary transfer action by the secondary transfer unit, on the intermediate transfer body. That is, when the image forming operation is restarted after the jammed paper is removed, the amount of toner existing on the intermediate transfer body is much larger as compared to the residual toner remaining on the intermediate transfer body after secondary transfer. Further, this large amount of toner is strongly charged to the normal polarity because the toner has not received the secondary transfer action. In the image formation apparatus conventionally proposed, the large amount of toner charged to the normal polarity is also forcefully charged to the polarity opposite to the normal polarity by the charger. This charged toner is supposed to be electrostatically returned to the surface of the image carrier. However, it is difficult to charge the entire toner in the large amount, which has been strongly charged to the normal polarity, to the polarity opposite to the normal polarity by the charger. Accordingly, the large amount of toner that has not been shifted to the surface of the image carrier remains on the intermediate transfer body. This remaining toner is shifted onto a next recording medium, so that the recording medium may be soiled by the toner.

SUMMARY OF THE INVENTION

It is an object of this invention to provide an image formation apparatus that can more effectively reduce the amount of toner shifted to a recording medium out of the toner that remains on an intermediate transfer body without being cleaned as compared to the conventional case.

In the image formation apparatus according to this invention, the absolute value of a voltage to be applied to the cleaning member is set to a value greater than the absolute value of a voltage applied to the cleaning member at which toner removal efficiency, when the second cleaning device removes any toner on the intermediate transfer body not having received the secondary transfer action by the secondary transfer unit therefrom, is maximum.

At that time, it is advantageous to set the absolute value of the voltage to be applied to the cleaning member to a value 1.5 or more times the absolute value of the voltage applied to the cleaning member at which the toner removal efficiency, when the second cleaning device removes any toner on the intermediate transfer body not having received the secondary transfer action by the secondary transfer unit therefrom, is maximum.

Further, it is also possible to set the voltage to be applied to the cleaning unit so that the followings are obtained. The absolute value of an average charge amount of toner on the intermediate transfer body, after passing through the second cleaning device without receiving the secondary transfer action by the secondary transfer unit and before reaching the primary transfer region where the primary transfer is performed, becomes ⅕ to 4 times the absolute value of an average charge amount of the toner before reaching the second cleaning device. In addition, the charge polarity of the toner before reaching the second cleaning device is opposite to that of the toner after passing through the second cleaning device.

Further, it is advantageous that the cleaning member is formed with a cleaning roller which is rotatably driven, and the cleaning unit is formed with a blade which is in contact with the surface of the cleaning roller with pressure to scrape off the toner deposited on the surface of the cleaning roller. It is also advantageous that the surface roughness of the cleaning roller is set to a value equivalent to or less than the average diameter of toner particles.

Further, it is advantageous that the cleaning member is formed with a brush roller which is rotatably driven, and the cleaning unit is formed with a flicker which is in contact with a brush of the brush roller to flick off the toner stuck to the brush.

Further, it is advantageous that the cleaning member is formed with the brush roller which is rotatably driven, and the cleaning unit has a recovery roller which rotates while being in contact with the brush of the brush roller and electrostatically recovers the toner stuck to the brush and a blade which scrapes off the toner deposited on the surface of the recovery roller. It is also advantageous that the surface roughness of the recovery roller is set to a value equivalent to or less than the average diameter of toner particles.

Other objects and features of this invention will become apparent from the following description with reference to the accompanying drawings.

DESCRIPTION OF THE PREFERRED EMBODIMENTS

A preferred embodiment of this invention is explained below with reference to the accompanying drawings.

Figure 1:
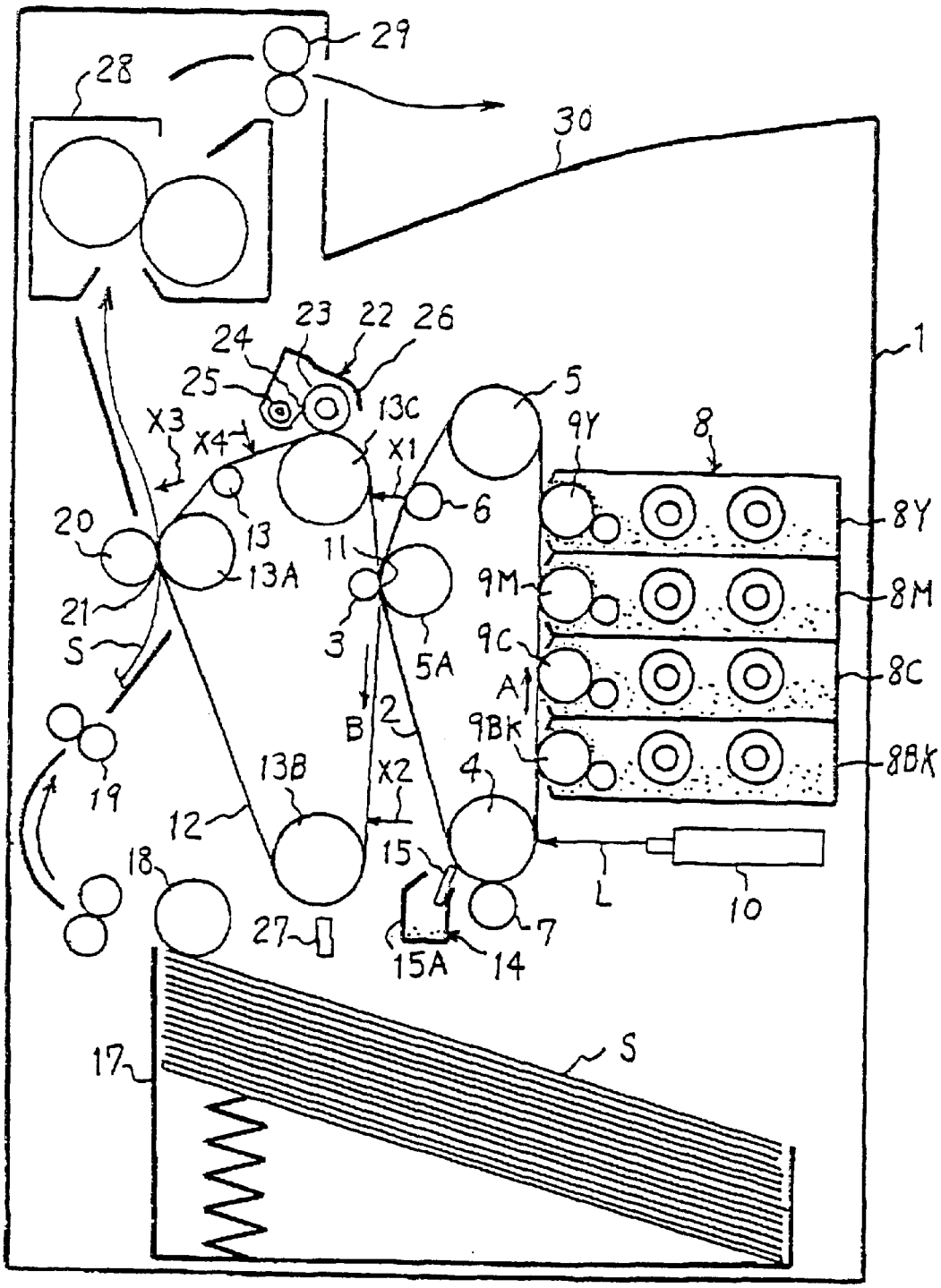
FIG. 1 is a cross-sectional view schematically showing an example of the image formation apparatus.

The cross-sectional view in FIG. 1 shows the outline of the image formation apparatus according to one embodiment of this invention. An endless belt-shaped photosensitive body 2 having flexibility, which is an example of the image carrier, is disposed inside the main body of the image formation apparatus. This photosensitive body 2 is wound round three rollers 4, 5, and 5A and a backup roller 6, and is rotatably driven in the direction indicated by the arrow A during image forming operation. A drum-shaped image carrier may be used as well instead of the belt-shaped image carrier. Both of the belt-shaped image carrier and the drum-shaped image carrier are driven so that the surface of each of the image carriers moves.

A charging roller 7 as an example of a charging device is opposed to the photosensitive body 2. Further, a development device 8 positioned on the downstream side from the charging roller 7 in the movement direction of the surface of the photosensitive body is opposed to the photosensitive body 2. This development device 8 has a yellow developing unit 8Y that stores yellow toner, a magenta developing unit 8M that stores magenta toner, a cyan developing unit 8C that stores cyan toner, and a black developing unit 8BK that stores black toner. In this type of development device 8, a powder type of one-component developer is used, but a powder type of two-component developer having toner and carrier can also be used. The respective toner stored in these developing units 8Y, 8M, 8C, and 8BK is carried on developing rollers 9Y, 9M, 9C, and 9BK provided in these developing units, conveyed, and frictionally charged to a normal polarity. Polyester-base toner to be charged to a normal polarity as a negative is used in this example, but toner to be charged to a normal polarity as a positive can also be used.

The charging roller 7 rotates while being in contact with the surface of the photosensitive body 2 that rotates in the direction of the arrow A. The surface of the photosensitive body is uniformly charged, by the voltage applied to the charging roller 7, to a predetermined polarity: a negative polarity the same as the normal polarity of the charged toner in the example in FIG. 1. An optically modulated laser beam L, that is emitted from a laser writing unit 10 as an example of an exposure device, is selectively irradiated to the surface of the photosensitive body thus charged, thereby a first electrostatic latent image is formed on the surface of the photosensitive body. A surface area of the photosensitive body to which the laser beam L is irradiated is an area where the electrostatic latent image is formed, while the other surface area of the photosensitive body to which the laser beam L is not irradiated is a background area. The first electrostatic latent image is visualized as a toner image by one of the plural developing units 8Y, 8M, 8C, and 8BK: the yellow developing unit 8Y in this example. The yellow toner carried on the developing roller 9Y of the yellow developing unit 8Y and conveyed is electrostatically shifted to the first electrostatic latent image, so that the electrostatic latent image is visualized as a toner image of yellow color. As explained above, the development device 8 serves as a role of visualizing the electrostatic latent image as a toner image by the toner charged to the normal polarity.

The toner image is primarily transferred to the surface of the intermediate transfer body 12 in a primary transfer region 11. The intermediate transfer body 12 shown here is also formed in an endless belt shape with flexibility. This intermediate transfer body 12 is wound round a plurality of rollers 3, 13B, 13A, 13, and 13C including a primary transfer roller 3 and a backup roller 13, and rotatably driven in the direction of the arrow B. In the intermediate transfer body 12 in this embodiment, the volume resistivity of a base layer provided in the inner side of the body 12 is set to $10^{10}$ to $10^{13}$ ohm-cm, and the surface resistivity of a surface layer on its outside is set to $10^{13}$ to $10^{15}$ ohms/square. The main resin forming the surface layer is fluororesin that is superior in peelability. A drum-shaped intermediate transfer body may be used instead of the belt-shaped intermediate transfer body. However, even if either type of the intermediate transfer bodies is used, the intermediate transfer body is driven so that its surface moves.

The intermediate transfer body 12 is brought into contact with the surface of the photosensitive body 2 in the primary transfer region 11. The primary transfer roller 3 is disposed on the back of the intermediate transfer body at the contact portion between these bodies. A positive voltage, which is the polarity opposite to the charge polarity of the toner on the photosensitive body 2, that is, the polarity opposite to the normal polarity, is applied to this primary transfer roller 3 by a power source not shown. Accordingly, an electric field is created in the primary transfer region 11, that is, the contact portion between the intermediate transfer body 12 and the photosensitive body 2, or in the area including and around the contact portion. More specifically, this electric field in the direction, that shifts the toner on the photosensitive body 2 charged to the normal polarity to the surface of the intermediate transfer body 12, is created therein. Further, the toner image on the photosensitive body is then primarily transferred to the surface of the intermediate transfer body 12.

The primary transfer roller 3 to which the voltage is thus applied forms an example of the primary transfer unit that primarily transfers the toner image on the image carrier to the intermediate transfer body. As the primary transfer roller 3, a stainless steel roller is used in this embodiment. This primary transfer roller 3 made of metal contacts the back of the intermediate transfer body 12, and the voltage is applied to the roller 3. However, the intermediate transfer body 12 has the resistance, which can prevent such inconvenience that a large amount of current flows into the intermediate transfer body 12 to cause high Joule heat to be liberated and the intermediate transfer body 12 is degraded by this heat.

As a replacement for the primary transfer roller 3, a primary transfer unit formed with, for example, a corona discharger positioned apart from the back of the intermediate transfer body 12 may also be used. Further, the photosensitive body 2 and the intermediate transfer body 12 are opposed to each other with a small gap therebetween. The toner image on the photosensitive body can also be primarily transferred to the surface of the intermediate transfer body by flying the toner on the photosensitive body onto the intermediate transfer body 12.

Any residual toner existing on the surface of the photosensitive body, from which the toner image has been primarily transferred to the intermediate transfer body 12, is cleaned off therefrom by the first cleaning device 14. This first cleaning device 14 is disposed on the downstream side from the primary transfer region 11 and is opposed to the portion of the surface of the photosensitive body on the upstream side from the charging roller 7 with respect to the movement direction of the surface of the photosensitive body. In the shown example, this first cleaning device 14 has the cleaning member formed with a cleaning blade 15 in contact with the surface of the photosensitive body with pressure, and a cleaning case 15A that supports this cleaning member. Any residual toner on the photosensitive body is scraped off therefrom by this cleaning member.

In the same manner as explained above, the surface of the photosensitive body is charged by this charging roller 7. A laser beam L is irradiated to the charged surface to form a second electrostatic latent image on the photosensitive body. This electrostatic latent image is visualized as a toner image of magenta color by the magenta developing unit 8M of the development device 8. This toner image is primarily transferred to the surface of the intermediate transfer body 12 so as to be superposed on the yellow toner image which has been primarily transferred in the previous stage in the primary transfer region 11. The surface of the photosensitive body after the transfer is cleaned by the first cleaning device 14.

Subsequently, in the same manner as explained above, a toner image of cyan color and a toner image of black color are successively formed on the photosensitive body by the cyan developing unit 8C and the black developing unit 8BK. These toner images are primarily transferred successively onto the intermediate transfer body so as to be superposed on the toner images thereon obtained by being primarily transferred in the previous stages. Each time each toner image is primarily transferred onto the intermediate transfer body, the residual toner after the transfer remaining on the photosensitive body 2 is cleaned off by the first cleaning device 14. In thus manner, a full-color image obtained by superposing the toner images of different colors on one another is formed on the surface of the intermediate transfer body 12.

On the other hand, a paper feed cassette 17 is provided in the lower area of the main body of the image formation apparatus 1. This paper feed cassette 17 stores sheet-shaped recording media S with flexibility such as transfer paper, resin sheets, resin films or clothes. The recording media S are fed out one by one through rotation of the paper feed roller 18 in contact with the surface of the top sheet of the recording media S. The fed-out recording medium S is fed into a nip between the intermediate transfer body 12 and a secondary transfer roller 20 in contact with the surface of the body 12. This is performed at a timing of matching the toner image on the intermediate transfer body 12 by rotation of a resist roller pair 19. At this time, a voltage having a polarity opposite to the normal polarity of the charged toner on the intermediate transfer body 12: a positive polarity in this embodiment is applied to the secondary transfer roller 20. Accordingly, an electric field in the direction that shifts the toner on the intermediate transfer body 12 onto the recording medium is created in a secondary transfer region 21, that is, a contact portion between the secondary transfer roller 20 and the intermediate transfer body 12, or in an area including and around the contact portion. Accordingly, the toner image on the intermediate transfer body 12 is secondarily transferred collectively onto the recording medium S.

In the shown example, the secondary transfer roller 20 is formed with a conductive core metal and an elastic body fixed to the outer periphery of the metal. The elastic body is formed with an EPDM foam body with its volume resistivity of $10^7$ to $10^9$ ohm-cm and hardness of 25 to 40 degrees (in Asuka C Scale). The voltage is applied to the core metal. Alternatively, the secondary transfer roller 20 is separated from the surface of the intermediate transfer body 12, and the toner image on the intermediate transfer body may be secondarily transfer onto the recording medium through its flight by the action of the electric field.

As explained above, the secondary transfer roller 20 to which the voltage is applied forms an example of the secondary transfer unit that secondarily transfers the toner image on the intermediate transfer body onto the recording medium. Further, a secondary transfer unit such as a corona discharger can be used as necessary.

The secondary transfer roller 20 is supported so that the roller 20 is abuttable with respect to the surface of the intermediate transfer body 12. When the toner image on the intermediate transfer body 12 is secondarily transferred collectively onto the recording medium S, the secondary transfer roller 20 is brought into contact with the surface of the intermediate transfer body 12 via the recording medium. The toner image is secondarily transferred to the surface of the recording medium S thus fed into the nip between the secondary transfer roller 20 and the intermediate transfer body 12. When the secondary transfer is not performed, the secondary transfer roller 20 is separated from the surface of the intermediate transfer body 12. Accordingly, such inconvenience that the toner image on the intermediate transfer body 12 may be distorted by the secondary transfer roller 20 is inhibited.

The recording medium S onto which the toner image is secondarily transferred from the intermediate transfer body 12 passes through a fixture device 28. During this passage, the toner image on the recording medium S is fixed to the surface of the recording medium by the action of heat and pressure. The recording medium S with a full-color image thus formed on its surface is ejected by a paper output roller pair 29 to a paper output section 30, which is formed with an upper wall section of the main body of the image formation apparatus 1.

A second cleaning device 22 is provided on the surface portion of the intermediate transfer body on the downstream side from the secondary transfer region 21 and the upstream side from the primary transfer region 11 with respect to the movement direction of the surface of the intermediate transfer body 12. As enlarged in FIG. 2, this cleaning device 22 has a cleaning member, a blade 24, and a cleaning case 26 as follows. This cleaning member is formed with a conductive cleaning roller 23. When any residual toner is to be removed from the intermediate transfer body 12, this cleaning roller 23 is in contact with the surface of the intermediate transfer body 12 and is rotatably driven in the direction of its movement the same as that of the surface of the intermediate transfer body at the contact portion. This blade 24 is in contact with the surface of the cleaning roller 23 with pressure, and scrapes off the toner deposited on the surface. Further, this cleaning case 26 supports the cleaning roller 23 and the blade 24. The cleaning roller 23 in the shown example is made of stainless steel.

A voltage having a polarity opposite to the normal polarity of the charged toner is applied to the cleaning roller 23 by a power source not shown. Accordingly, an electric field is created. This electric field has the direction that shifts any residual toner charged to the normal polarity deposited on the intermediate transfer body 12 to the side of the cleaning roller 23. Thereby, the residual toner is removed from the surface of the intermediate transfer body. The toner shifted from the surface of the intermediate transfer body to the cleaning roller 23 is scraped by the blade 24 in contact with the surface of the cleaning roller 23 with pressure. The scraped toner is carried to a waste toner tank not shown by a toner-carrying device 25. The cleaning roller 23 always directs its surface cleaned by the blade 24 toward the surface of the intermediate transfer body 12. Accordingly, the residual toner remaining on the intermediate transfer body is shifted to the cleaned surface. As explained above, the blade 24 forms an example of the cleaning unit that removes the toner shifted to the cleaning member from the surface of the intermediate transfer body.

The second cleaning device 22 is supported so that the device 22 can be close to or apart from the surface of the intermediate transfer body 12. Thereby the cleaning roller 23 can be brought into contact with or separated from the surface of the intermediate transfer body. The cleaning roller 23 is separated from the surface of the intermediate transfer body except the case where the residual toner is removed from the surface of the intermediate transfer body. Accordingly, such inconvenience that the toner image on the intermediate transfer body 12 before being secondarily transferred onto the recording medium S may be distorted by the cleaning roller 23 is overcome.

The image forming operations are successively performed, and a full-color toner image is secondary-transferred successively to each of the recording media S sent to the secondary transfer region 21 between the intermediate transfer body 12 and the secondary transfer roller 20. Each of the toner images is fixed by the fixture device 28. Any residual toner deposited on the intermediate transfer body, from which the toner image has been secondarily transferred, is removed from the surface of the intermediate transfer body by the second cleaning device 22.

Instead of the operation for superposing the toner images of four colors on one another on the intermediate transfer body and secondarily transferring these images collectively onto the recording medium, it is also possible to primarily transfer toner images of one color to three colors onto the intermediate transfer body and secondarily transfer these images onto the recording medium S.

As explained above, the image formation apparatus according to this embodiment has the image carrier on which an electrostatic latent image is formed while the carrier is driven so that its surface moves, the development device 8 which visualizes the electrostatic latent image as a toner image by the toner charged to the normal polarity, and the intermediate transfer body 12 driven so that its surface moves. The image formation apparatus also has the primary transfer unit which creates the electric field in the direction that shifts the toner charged to the normal polarity from the image carrier to the intermediate transfer body 12, and primarily transfers the toner image on the image carrier onto the intermediate transfer body 12. The image formation apparatus also has the first cleaning device 14 which removes any residual toner existing on the surface of the image carrier from which the toner image has been primarily transferred to the intermediate transfer body 12. Further, the image formation apparatus has the secondary transfer unit which creates the electric field in the direction that shifts the toner charged to the normal polarity from the intermediate transfer body 12 onto the recording medium S and secondarily transfers the toner image on the intermediate transfer body 12 onto the recording medium, and the second cleaning device 22 which removes any residual toner existing on the surface of the intermediate transfer body from which the toner image has been secondarily transferred onto the recording medium. This second cleaning device 22 has the cleaning member which is opposed to the surface of the intermediate transfer body and to which the voltage having the polarity opposite to the normal polarity is applied, and the cleaning unit which removes the toner shifted to the cleaning member from the surface of the intermediate transfer body.

The surface of the intermediate transfer body from which the toner image has been secondarily transferred is cleaned by the second cleaning device 22. If a large amount of toner remains on the intermediate transfer body 12 after the cleaning due to its unsatisfactory cleaning, the toner remaining on the intermediate transfer body is shifted onto the recording medium S at the time of secondarily transferring the next toner image onto the next recording medium S. Accordingly, such inconvenience that the recording medium S may be soiled by the toner inevitably occurs.

As explained above, when the image forming operation is restarted after the paper jam is cleared, the large amount of toner deposited on the intermediate transfer body at that time passes through the place where the secondary transfer roller 20 is positioned apart from the intermediate transfer body. The toner then reaches the second cleaning device 22 without receiving the action of the transfer electric field, that is, without receiving the secondary transfer action by the secondary transfer roller 20, and the toner is removed from the surface of the intermediate transfer body by the second cleaning device 22. Further, in order to detect each status of the components for the image formation apparatus, or when a two-component developer is used in the development device, operations as follows are conventionally performed to detect the density of the toner. A pattern toner image is formed on the photosensitive body 2 by the development device 8, the image is transferred to the intermediate transfer body 12, and the image density of the toner image is detected by a photosensor 27 provided opposite to the intermediate transfer body 12. However, when this pattern toner image is passing through the secondary transfer roller 20, this secondary transfer roller 20 is also separated from the intermediate transfer body 12. Accordingly, the pattern toner image reaches the second cleaning device 22 without receiving the secondary transfer action, and is removed here from the surface of the intermediate transfer body. Any toner not having received the secondary transfer action is also removed from the surface of the intermediate transfer body by the second cleaning device 22. However, if a large amount of toner is deposited on the intermediate transfer body 12 after the cleaning due to its unsatisfactory cleaning, such inconvenience that the toner may shift to the next recording medium inevitably occurs.

Therefore, conventionally, the voltage to be applied to the cleaning roller has been set so as to remove the toner from the intermediate transfer body with the highest efficiency. However, based on this configuration, when a portion of the intermediate transfer body cleaned by the second cleaning device 22 reaches the secondary transfer region and is brought into contact here with the next recording medium, any toner deposited on the portion of the intermediate transfer body due to its unsatisfactory cleaning is more easily shifted onto the recording medium.

Figure 3:
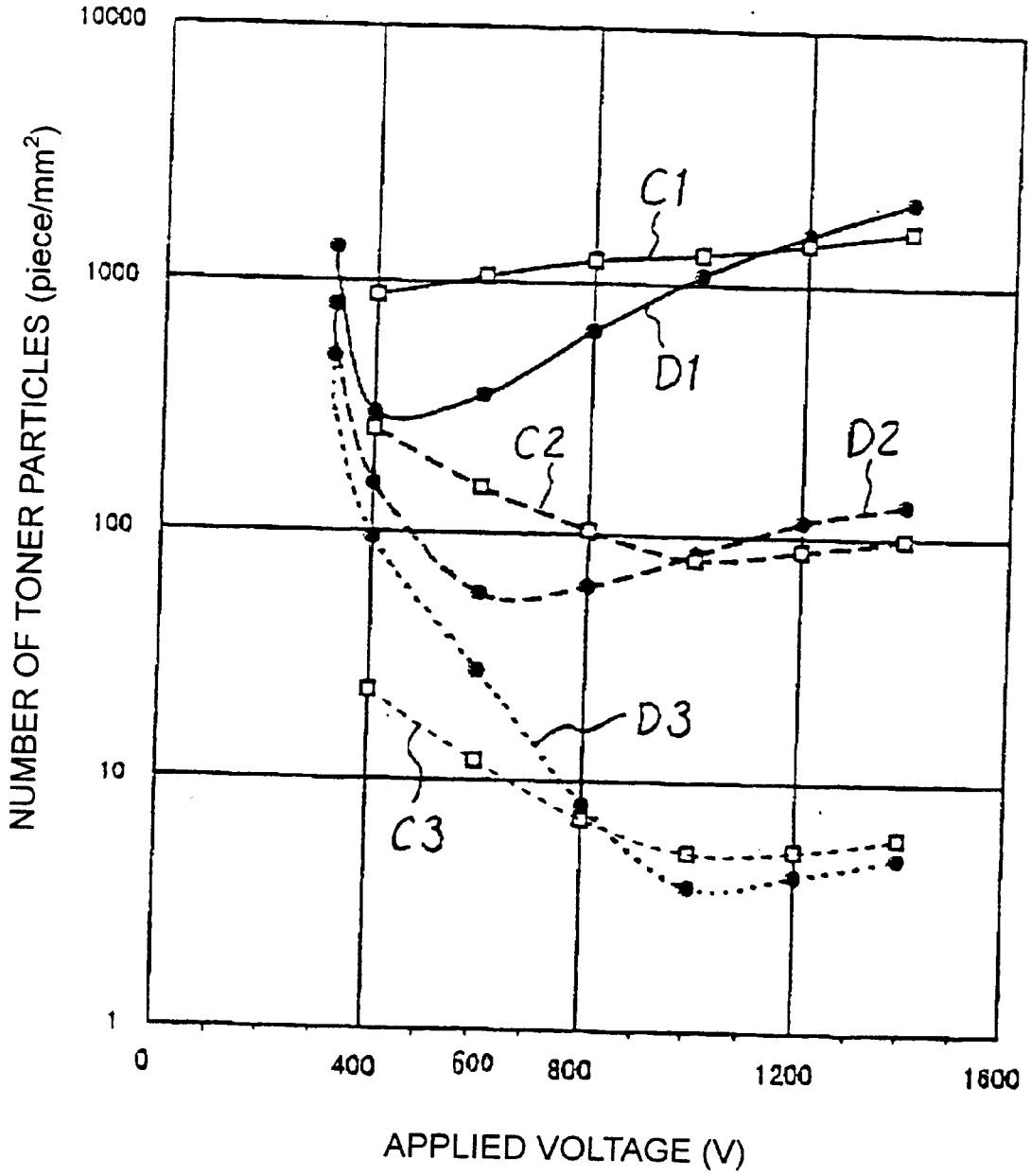
FIG. 3 is a graph showing an example of a relation between the voltage applied to the cleaning roller and the amount of toner on the intermediate transfer body.
Figure 4:
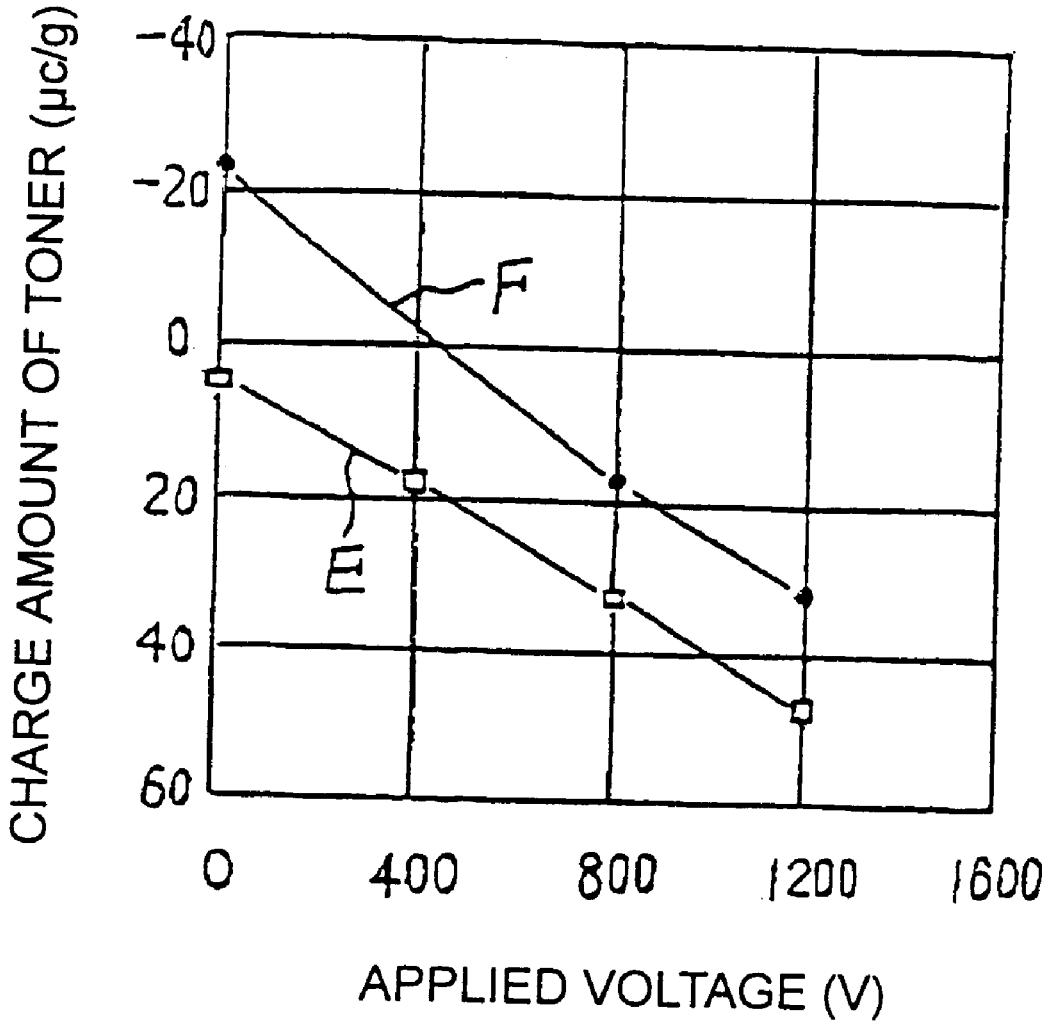
FIG. 4 is a graph showing an example of a relation between the voltage applied to the cleaning roller and the charge amount of toner.

The examples in FIG. 3 and FIG. 4 show results of experiments that reveal this fact. These experiments were carried out to examine how many toner particles were deposited on the intermediate transfer body and the next recording medium in two cases. More specifically, the image forming operation was performed using the image formation apparatus shown in FIG. 1, and these two cases were compared. One of these cases is that the surface of the intermediate transfer body, from which the toner image had been secondarily transferred, was cleaned by the second cleaning device 22. The other case is that the toner not having received the secondary transfer action on the intermediate transfer body was removed therefrom by the second cleaning device 22. The X-axis in FIG. 3 shows the voltage applied to the cleaning roller 23 of the second cleaning device 22. The Y-axis shows the number of toner particles existing within an area per square millimeter on the intermediate transfer body or on the recording medium.

Lines C1, C2, and C3 in FIG. 3 show results of tests carried out by performing the ordinary image forming operation and the operations as follows. The toner image on the intermediate transfer body was secondarily transferred onto the recording medium S through the action of a transfer electric field by the secondary transfer roller 20, and the surface of the intermediate transfer body after the secondary transfer was then cleaned by the second cleaning device 22. As explained above, each of the lines C1, C2, and C3 shows a relation between the number of toner particles and the voltage. This number of toner particles is obtained as a result of removing the residual toner, which has received the secondary transfer action by the secondary transfer roller 20, by the second cleaning device 22. The voltage is applied to the cleaning roller 23 of the second cleaning device 22 during the cleaning. The line C1 of these lines shows the number of toner particles remaining, without being cleaned by the second cleaning device 22, on the intermediate transfer body after having passed through the second cleaning device 22 and before passing through the primary transfer region 11, that is, on the portion of the intermediate transfer body indicated by the sign X1 in FIG. 1. The line C2 shows the number of toner particles remaining on the portion of the intermediate transfer body which has passed through the second cleaning device 22 and further passed through the primary transfer region 11, that is, on the portion of the intermediate transfer body indicated by the sign X2 in FIG. 1. Further, the line C3 shows the number of toner particles shifted to the surface X3 of the recording medium S, out of the toner remaining on the portion of the intermediate transfer body due to its unsatisfactory cleaning, when the portion of the intermediate transfer body, which has passed through the second cleaning device 22 and further passed through the primary transfer region 11, is passing through the secondary transfer region 21 where the next recording medium S is passing.

Each of the lines D1, D2, and D3 in FIG. 3 shows a relation between the number of toner particles and the voltage. The number of toner particles is obtained as a result of removing any toner reaching the second cleaning device 22, without receiving the secondary transfer action, by the second cleaning device 22. The voltage is applied to the cleaning roller 23 of the second cleaning device 22 during this cleaning. The line D1 of these lines shows the number of toner particles remaining without being cleaned on the intermediate transfer body reaching the place indicated by the sign X1 in FIG. 1 after passing through the cleaning device 22. The line D2 shows the number of toner particles remaining on the portion of the intermediate transfer body, indicated by the sign X2 in FIG. 1, after passing through the second cleaning device 22 and the primary transfer region 11. Further, the line D3 shows the number of toner particles shifted to the surface X3 of the next recording medium S from the portion of the intermediate transfer body when the portion of the intermediate transfer body, which has passed through the second cleaning device 22 and the primary transfer region 11, is passing through the secondary transfer region 21 where the next recording medium S is passing.

The graph in FIG. 4 shows the voltage applied to the cleaning roller 23 that is measured on the X-axis the same as FIG. 3 and the average charge amount ($\mu$c/g) of toner remaining on the intermediate transfer body after being cleaned by the second cleaning device 22 on the Y-axis. The line E in FIG. 4 shows the average charge amount of toner remaining without being cleaned on the portion of the intermediate transfer body indicated by the sign X1 in FIG. 1. More specifically, the ordinary image forming operation that the toner image on the intermediate transfer body is secondarily transferred onto the recording medium S is performed, and the average charge amount is measured immediately after the residual toner, which has received the secondary transfer action, is removed by the second cleaning device 22. The line F shows the average charge amount of toner remaining on the portion of the intermediate transfer body indicated by the sign X1 in FIG. 1 after the toner, which has not received the secondary transfer action, on the intermediate transfer body is removed by the second cleaning device 22.

The value of the charge amount of toner when the voltage is 0 in FIG. 4 does not indicate the value of the toner charge amount when the voltage applied to the cleaning roller 23 is 0, but shows the charge amount of the toner deposited on the portion of the intermediate transfer body immediately before reaching the second cleaning device 22, that is, on the portion indicated by X4 in FIG. 1.

The amount of toner that was not cleaned and was deposited on the portion of the intermediate transfer body indicated by the sign X2 and the amount of toner deposited on the surface of the recording medium indicated by the sign X3 were extremely small. Therefore, the charge amount of the toner could not be measured.

As is clear from FIG. 4, in association with increase in the voltage applied to the cleaning roller 23, the charge amount of the toner on the intermediate transfer body at the position immediately after passing through the second cleaning device 22, that is, at the position indicated by X1 in FIG. 1 increases in the side of the polarity opposite to the normal polarity. This is because charge having a polarity opposite to the normal polarity is added to the toner. This addition is performed when the toner is passing through the cleaning device 22 by Paschen discharge that occurs at fine gap regions in front and in the rear of a contact portion between the cleaning roller 23 and the intermediate transfer body 12 based on a cleaning electric field created by the voltage applied to the cleaning roller 23. This addition is also performed by charge shift from the cleaning roller 23 to the toner when the toner is brought into contact with the cleaning roller 23.

A difference in charge amounts is found between the toner (line F) that has not received the secondary transfer action and the toner (line E) that has received the same action. This is because the toner is charged to the polarity opposite to the normal polarity when the toner receives the secondary transfer action.

The toner remaining on the surface of the portion of the intermediate transfer body immediately after passing through the second cleaning device 22, that is, on the surface of the portion of the intermediate transfer body indicated by the sign X1 in FIG. 1 is called "residual toner after cleaning" as required. The toner remaining on the surface of the portion of the intermediate transfer body that has passed through the second cleaning device 22 and further passed through the primary transfer region 11, that is, on the surface of the portion of the intermediate transfer body indicated by the sign X2 in FIG. 1 is called "residual toner after primary transfer" as required. Likewise, some of the residual toner after primarily transfer, that is shifted to the next recording medium S, is called "toner shifted to the recording medium" as required.

As is clear from the lines C1 and D1 in FIG. 3, in either case of the toner having received the secondary transfer action and the toner not having received the same action, the amount of residual toner after cleaning becomes smaller when the voltage applied to the cleaning roller 23 of the second cleaning device 22 is 400 volts. Particularly, in the case of the toner not having received the secondary transfer action, the amount of the residual toner after cleaning becomes a minimum.

As explained above, in the example of the experiment in FIG. 3, toner removal efficiency, when the second cleaning device 22 removes any toner not having received the secondary transfer action by the secondary transfer roller 20 from the intermediate transfer body, becomes a maximum when the voltage applied to the cleaning roller 23 is 400 volts. This is because when the voltage applied to the cleaning roller 23 is lower than 400 volts, the electric field in the direction that shifts the toner from the intermediate transfer body 12 to the cleaning roller 23 is too weak, therefore, the cleaning efficiency of the intermediate transfer body decreases. Conversely, if the voltage applied to the cleaning roller 23 is set to a value greater than 400 volts, the charge polarity of the toner not having received the secondary transfer action is inverted to the polarity opposite to the normal polarity, as is clear from FIG. 4. Therefore, the amount of toner electrostatically attracted to the side of the cleaning roller 23, to which the voltage having the polarity opposite to the normal polarity is applied, becomes smaller. Conventionally, from such viewpoints, the voltage applied to the cleaning roller 23 is set to a value, for example, 400 volts in FIG. 3, at which the cleaning efficiency of the intermediate transfer body becomes the highest. Based on this setting, both of the toner having received the secondary transfer action and the toner not having received the same action are efficiently shifted to the cleaning roller 23, thus increasing the cleaning efficiency.

However, as is clear from the lines C3 and D3 in FIG. 3, when the voltage applied to the cleaning roller 23 is set to 400 volts, the amount of toner shifted to the recording medium becomes rather larger as compared to the case where the voltage applied to the cleaning roller 23 is greater than 400 volts. In the case of the toner not having received the secondary transfer action indicated by the line D3, when the voltage of 400 volts is applied to the cleaning roller 23, toner particles of about 100 pieces/mm$^2$ are supposed to shift onto the next recording medium. If such a large number of toner particles are shifted onto the recording medium, the toner particles become visible as a light half toned afterimage, which is not preferable.

In contrast, if the voltage applied to the cleaning roller 23 is greater than 400 volts, the amount of toner shifted to the recording medium becomes smaller although such efficiency that the second cleaning device 22 removes the toner from the intermediate transfer body decreases. The reason will be assumed as follows.

If the voltage applied to the cleaning roller 23 is set to a value greater than 400 volts, as is clear from FIG. 4, both of the toner not having received the secondary transfer action and the toner having received this action tend to be strongly charged to the polarity opposite to the normal polarity. Accordingly, a greater value of voltage applied to the cleaning roller 23 makes the tendency more increased. On the other hand, in the primary transfer region 11, an electric field in the direction, that shifts the toner charged to the normal polarity from the photosensitive body 2 to the intermediate transfer body 12, is created by the voltage applied to the primary transfer roller 3. Accordingly, when the residual toner after cleaning charged to the polarity opposite to the normal polarity on the intermediate transfer body 12 reaches the primary transfer region 11, some of the toner is electrostatically returned to the surface of the photosensitive body 2. This phenomenon can be understood also from the lines C2 and D2 in FIG. 3. The toner thus returned to the photosensitive body 2 together with other residual toner on the photosensitive body is removed from the surface of the photosensitive body by the first cleaning device 14.

As explained above, when the voltage applied to the cleaning roller 23 is set to the value greater than 400 volts, some of the residual toner after cleaning is returned to the photosensitive body 2. Further, some residual toner after primary transfer, which has not been shifted to the photosensitive body 2, on the intermediate transfer body is charged to the polarity opposite to the normal polarity. Therefore, this residual toner after primary transfer charged to the polarity opposite to the normal polarity is hard to be deposited onto a recording medium when this toner reaches the secondary transfer region 21, because the electric field in the direction, that electrostatically shifts the toner having the normal polarity on the intermediate transfer body onto the recording medium, has been created in this region 21. In such a manner, the amount of toner shifted to the recording medium that finally shifts to the next recording medium S becomes also smaller. Thus, such inconvenience that the recording medium is soiled by the shifted toner can effectively be suppressed.

When the voltage applied to the cleaning roller 23 is 400 volts, in the case of some toner not having received the secondary transfer action, the average charge amount of the residual toner after cleaning is 0 or a little to the normal polarity, as is clear from the line F in FIG. 4. Therefore, there is no possibility that this toner is charged strongly to the opposite polarity to the normal polarity. In the case of the toner having received the secondary transfer action, the average charge amount of the residual toner after cleaning is about +20 $\mu$c/g, as is clear from the line E in FIG. 4. Therefore, this toner is not possibly charged strongly to the opposite polarity to the normal polarity. An extremely slight amount of such residual toner after cleaning is shifted to the photosensitive body 2 in this primary transfer region 11, while the amount of residual toner after primary transfer becomes larger, as is clear from the lines C2 and D2 in FIG. 3. Further, this residual toner after primary transfer is not so strongly charged to the polarity opposite to the normal polarity. Therefore, the toner is easily shifted onto the recording medium S in the secondary transfer region 21. Under these circumstances, as is clear from the lines C3 and D3 in FIG. 3, the toner shifted to the recording medium results in a large amount.

In the image formation apparatus according to this embodiment, in such terms, the absolute value of the voltage applied to the cleaning roller 23, as an example of the cleaning member for the second cleaning device 22, is set to the value greater than the absolute value of the voltage applied to the cleaning member (+400 volts in FIG. 3). This voltage applied to the cleaning member is such a value that the toner removal efficiency, when the second cleaning device 22 removes the toner not having received the secondary transfer action by the secondary transfer unit from the intermediate transfer body, is maximum. Accordingly, both of the toner not having received the secondary transfer action and the toner having received this action are removed by the second cleaning device 22. Any residual toner after cleaning due to unsatisfactory cleaning by this cleaning device 22 at that time is effectively returned to the photosensitive body 2 and recovered by the first cleaning device 14. Thus, effectively reducing the amount of the toner shifted to the recording medium as compared to the conventional manner.

Further, when the voltage applied to the cleaning roller 23 is 400 volts, the residual toner after cleaning not having received the secondary transfer action is an extremely small amount, so that the charge amount of the toner can not be measured. Accordingly, the charge amount of the toner at that time is not plotted in FIG. 4. However, it is possible to estimate the charge amount of toner when the voltage applied to the cleaning roller 23 is 400 volts from the charge amount of the toner when the voltage applied to the cleaning roller 23 is a value in the neighborhood of 400 volts.

As explained above, the voltage applied to the cleaning roller 23 is made greater than 400 volts, which can reduce the amount of toner shifted to the recording medium. As is clear from detailed analysis on FIG. 3, when the value of the voltage applied to the cleaning roller 23 is set to 600 volts or more, which is 1.5 times or more than 400 volts, particularly, to 800 volts or more, which is twice as great as 400 volts, the toner shifted to the recording medium can be reduced to an extremely small amount.

When the voltage applied to the cleaning roller 23 is between 600 to 800 volts, the amount of residual toner after cleaning unless the toner has received the secondary transfer action increases more largely than the case where the applied voltage is 400 volts. As is clear from FIG. 4, the charge polarity of the residual toner after cleaning is inverted to the polarity opposite to the normal polarity. Therefore, when the toner is passing through the primary transfer region 11, a large amount of toner shifts to the photosensitive body 2, so that the amount of residual toner after primary transfer becomes a minimum. However, when this toner is passing through the primary transfer region 11, the action of inverting the polarity of the toner to the normal polarity is again exerted on the toner. Accordingly, there exists some of the toner to be returned to the normal polarity, which will never reduce the amount of toner shifted to the recording medium to a minimum. When the voltage applied to the cleaning roller 23 is set to 600 volts, the toner particles of about 30 pieces/mm$^2$ are shifted onto the recording medium. When the residual toner after cleaning is passing through the primary transfer region 11, negative charge is delivered to the toner from the side of the photosensitive body 2. Therefore, it is assumed that the polarity of the toner is inverted to the normal polarity.

As explained above, when the voltage applied to the cleaning roller 23 is between 600 to 800 volts, the toner shifted to the recording medium becomes an extremely small amount, yet not a minimum, as compared to the case where the applied voltage is 400 volts. Such a small amount of toner shifted to the recording medium can not visually be recognized as an after image unless it is extremely carefully looked at. Thus, this is generally not brought to a problem.

When the voltage applied to the cleaning roller 23 is between 800 to 1200 volts, the amount of residual toner after cleaning further increases. However, the amount of toner shifted to the recording medium becomes a minimum: 10 pieces/mm$^2$ or less. Such an amount of toner can not be visually recognized as an afterimage, thus this amount of toner becomes practically insignificant.

The reason that the toner shifted to the recording medium becomes a minimum amount when the voltage applied to the cleaning roller 23 is between 800 to 1200 volts can be assumed as follows. As is clear from FIG. 4, when the applied voltage is between 800 to 1200 volts, the charge polarity of the residual toner after cleaning is strongly inverted to the polarity opposite to the normal polarity. Therefore, a large amount of the residual toner after cleaning is returned to the photosensitive body. However, the residual toner after cleaning is primarily a large amount. Therefore, when the toner has not received the secondary transfer action, the amount of residual toner after primary transfer increases more as compared to the case where the applied voltage is 600 volts. However, this residual toner after cleaning has been strongly charged to the polarity opposite to the normal polarity. Therefore, even if the toner receives again the action of inverting the charge polarity of the toner to the normal polarity when this toner is passing through the primary transfer region 11, only a slight amount of toner resultantly shifts onto the recording medium when the toner is passing through the secondary transfer region 21. Because almost all the residual toner after primary transfer, which has passed through the primary transfer region, has been charged to the polarity opposite to the normal polarity.

The toner on the intermediate transfer body having passed through the secondary transfer region 21 without shifting to the recording medium is charged to the polarity opposite to the normal polarity. Therefore, when reaching the primary transfer region 11 again, the toner effectively shifts to the photosensitive body by the action of the transfer electric field, and is recovered by the first cleaning device 14.

From such viewpoints, in the image formation apparatus according to this embodiment, the absolute value of the voltage applied to the cleaning roller 23 is set to a value 1.5 or more times (+600 volts in FIG. 3) the absolute value of the voltage applied to the cleaning member. More specifically, this set value is such that the toner removal efficiency, when the second cleaning device 22 removes the toner not having received the secondary transfer action by the secondary transfer unit from the intermediate transfer body, is maximum. Based on this configuration, the amount of toner shifted to the recording medium in particular can be effectively reduced.

If the voltage applied to the cleaning roller 23 is set to a value greater than 1200 volts, all the amounts of residual toner after cleaning, residual toner after primary transfer, and toner shifted to the recording medium tend to increase. However, the rate of their increase is extremely low. Therefore, even if the voltage applied to the cleaning roller 23 is set to a value greater than 1200 volts, the amount of toner shifted to the recording medium can be suppressed to a minimum. Even when this applied voltage was set to 1400 volts, the toner shifted to the recording medium could not visually be recognized as an afterimage.

However, when the voltage applied to the cleaning roller 23 is made too large and the cleaning electric field becomes too strong, leakage of a current from the cleaning roller 23 to the intermediate transfer body 12 occurs. If this leakage becomes significant, the intermediate transfer body may be broken, which may introduce an abnormal image. In the image formation apparatus shown in FIG. 1, when the voltage applied to the cleaning roller 23 is between 1600 to 2000 volts: 4 to 5 times the applied voltage at which the removal efficiency of toner not having received the secondary transfer action becomes a maximum, the leakage may start to occur. From such viewpoints, it is especially desirable to set the absolute value of a voltage applied to the cleaning member to any of 2 to 3 times (+800 to 1200 volts in FIG. 3) the value such that the toner removal efficiency, when the second cleaning member removes any toner not having received the secondary transfer action from the intermediate transfer body, becomes a maximum.

As is clear from the line F in FIG. 4, an average charge amount of the toner, which has not received the secondary transfer action, before reaching the second cleaning device 22 is about −20 $\mu$c/g. The average charge amount of the toner after passing through the second cleaning device 22 and before reaching the primary transfer region 11 is about +10 volts when the applied voltage is +600 volts. This average charge value is one-half the absolute value of the charge amount of the toner before reaching the second cleaning device 22. If this value is up to 4 times, preferably 1 to 2 times the absolute value, the amount of toner shifted to the recording medium can be effectively reduced.

As explained above, the voltage applied to the cleaning roller 23 as an example of the cleaning member is set to the value as explained below, which can reduce the amount of toner shifted to the recording medium without any trouble. This value is set so that the absolute value of an average charge amount of toner on the intermediate transfer body, after passing through the second cleaning device 22 without having received the secondary transfer action by the secondary transfer roller 20 as an example of the secondary transfer unit and before reaching the primary transfer region where primary transfer is executed, becomes ½ to 4 times, preferably 1 to 2 times the absolute value of the average charge amount of the toner before reaching the second cleaning device 22. Further, this value is set so that the charge polarity of the toner before reaching the second cleaning device 22 is opposite to that of the toner after passing through the second cleaning device 22.

Figure 2:
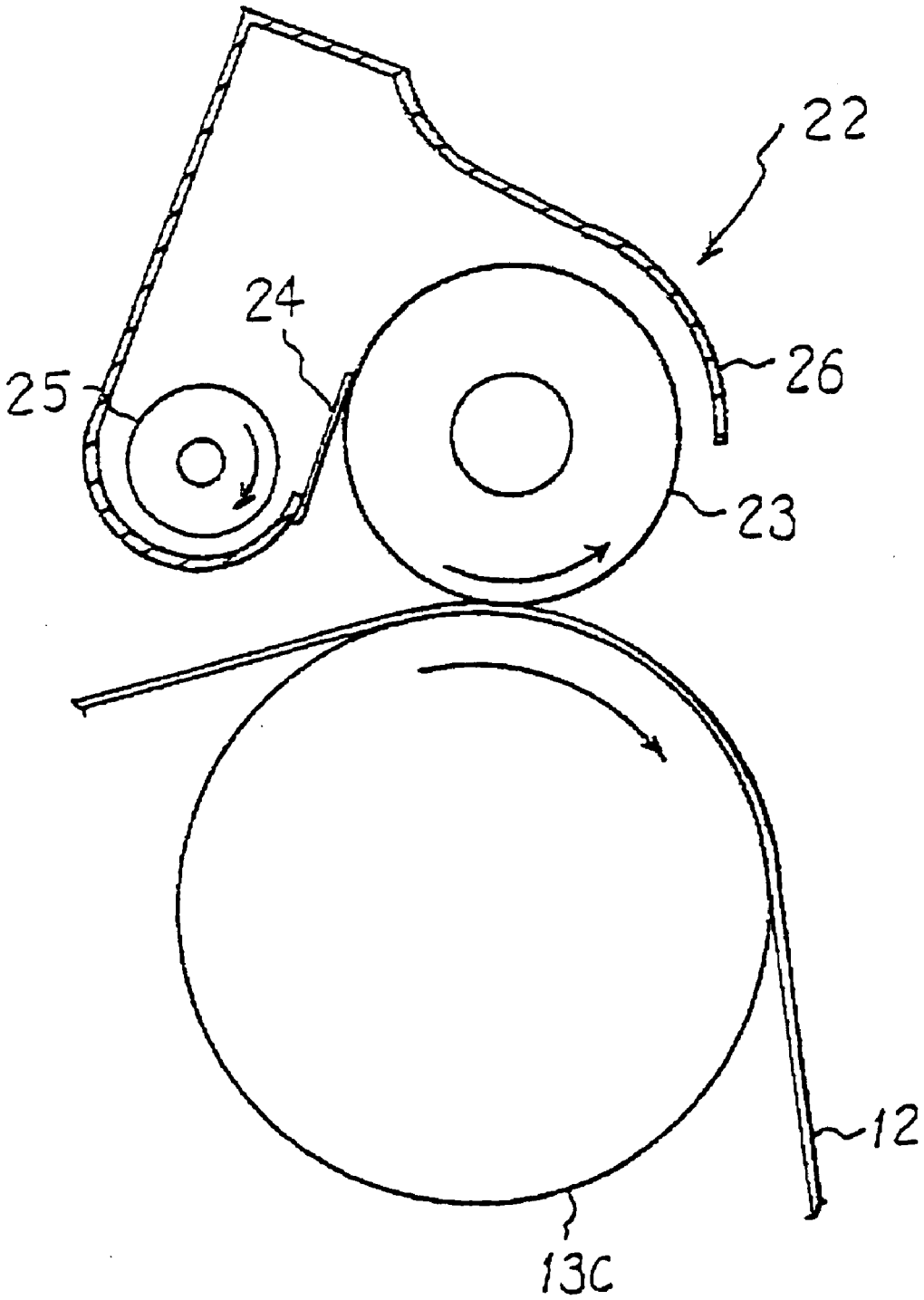
FIG. 2 is an enlarged view of the second cleaning device.

In the image formation apparatus shown in FIG. 1 and FIG. 2, the cleaning member of the second cleaning device 22 is formed with the cleaning roller 23 that is rotatably driven. Further, the cleaning unit, which cleans off the toner deposited on the cleaning roller 23, is formed with the blade 24 that is in contact with the surface of the cleaning roller 23 with pressure and scrapes off the toner deposited on the surface of the cleaning roller 23 therefrom. In this case, the surface roughness of the cleaning roller 23 is set to a value equivalent to or less than the average diameter of toner particles. If the surface roughness is set to this value, toner particles are hard to be stuck to the surface of the cleaning roller 23. Therefore, the cleaning roller is hardly soiled by the toner, which makes cleaning of the roller easier. For example, the surface roughness of the cleaning roller 23 is set to Rz 2.5 $\mu$m: finer than the average diameter of toner particles of 7.5 $\mu$m. Further, a polyurethane blade, for example, may be used as the blade 24, which is advantageous.

Figure 5:
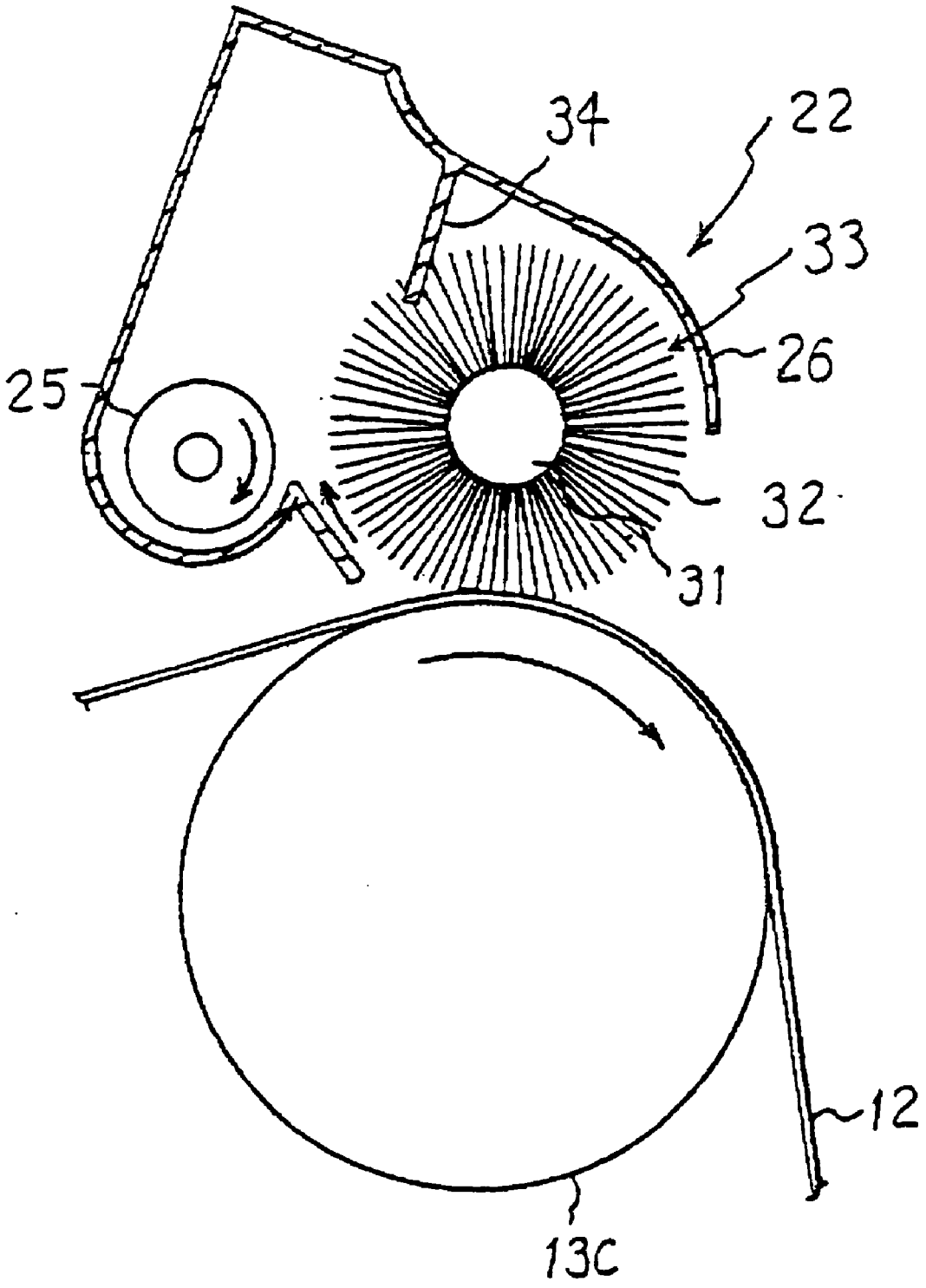
FIG. 5 is a cross-sectional view showing another example of the second cleaning device.

Alternatively, as shown in FIG. 5, the cleaning member of the second cleaning device 22 may be formed with a brush roller 33 that is provided with a conductive core metal 31 and a brush 32 provided around the outer periphery of the metal, and is rotatably driven. Further, the cleaning unit that cleans the brush roller 33 may be formed with a flicker 34 that is in contact with the brush 32 of the brush roller 33 and flicks off the toner stuck to the brush 32. The voltage of the value explained above is applied to the conductive core metal 31. According to this structure, the brush 32 of the rotating brush roller 33 scrapes toner on the intermediate transfer body. Further, the brush 32 effectively scrapes the toner deposited on the surface of the intermediate transfer body, which is the toner on the deepest side when the intermediate transfer body is viewed from its outside. Accordingly, the toner can efficiently be removed therefrom. Since the cost of the flicker 34 is low, the cleaning unit can be structured at a low cost.

Figure 6:
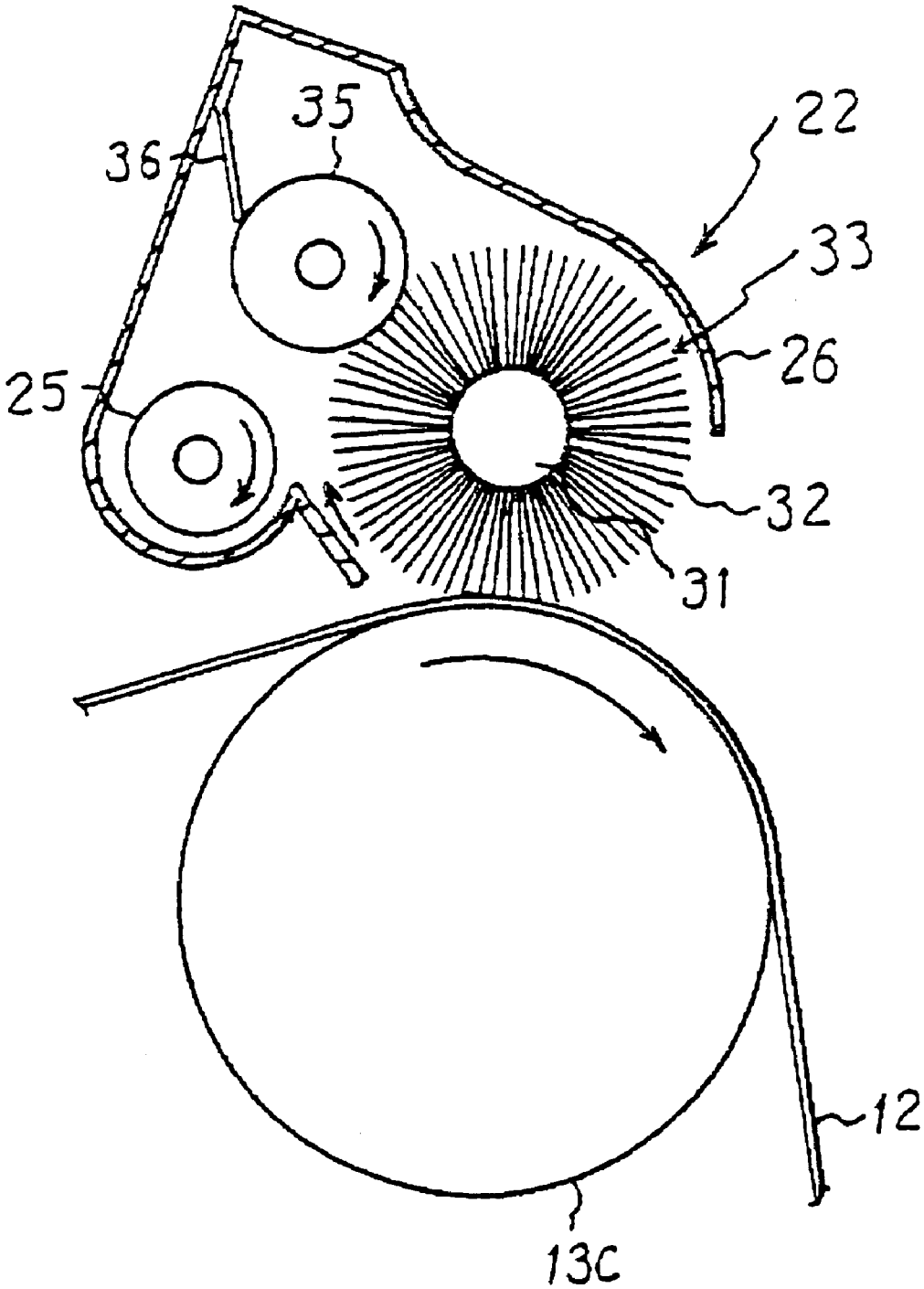
FIG. 6 is a cross-sectional view showing still another example of the second cleaning device.

Further, as shown in FIG. 6, the cleaning member of the second cleaning device 22 is formed with the brush roller 33 rotatably driven, which is the same as the case in FIG. 5. The cleaning unit for the brush roller 33 may be formed with a recovery roller 35 that rotates while being in contact with the brush 32 of the brush roller 33 and electrostatically recovers the toner stuck to the brush 32, and a blade 36 that scrapes off the toner deposited on the surface of the recovery roller 35 therefrom. The voltage is applied to the recovery roller 35 so as to create an electric field in the direction that electrostatically shifts the toner stuck to the brush 32 to the recovery roller. Such a recovery roller sucks the toner from the brush 32 while rotating. Based on this structure, the same effect as that of the structure shown in FIG. 5 can be achieved as well. In addition, the cleaning effect of the brush 32 can further be enhanced. In this case, the surface roughness of the recovery roller 35 is set to a value equivalent to or less than the average diameter of toner particles, which can prevent deposition of toner on the peripheral surface of the recovery roller. Therefore, the recovery roller 35 is hardly soiled by the toner, thus easily cleaning the recovery roller.

Further, the voltage is directly applied to the cleaning member structured in the various forms. In addition, the voltage may be indirectly applied to the cleaning member through another member. For example, the brush 32 of the brush roller 33 shown in FIG. 6 may be formed with a medium resistor. The voltage is applied to this brush roller 33 through application of the voltage to the conductive recovery roller 35, so that a cleaning electric field that shifts the toner to the brush roller 33 can be created between the brush roller 33 and the intermediate transfer body.

This invention is also applicable to various types of image formation apparatuses other than the one explained above.

According to this invention, the toner charged to the normal polarity remaining on the intermediate transfer body is removed by the second cleaning device, which reduces the amount of toner remaining on the intermediate transfer body. Further, the cleaning electric field stronger than the electric field where the toner removal effect is the maximum by the second cleaning device is created between the cleaning member and the intermediate transfer body. Accordingly, the polarity of the toner remaining on the intermediate transfer body due to unsatisfactory cleaning by the second cleaning device is inverted from the normal polarity. Further, the toner whose charge polarity has been inverted can be effectively returned to the surface of the image carrier in the primary transfer region. As explained above, the toner on the intermediate transfer body is removed twice, so that the toner remaining on the intermediate transfer body can be reduced to an extremely slight amount. In addition, the polarity of the toner remaining there on becomes the polarity opposite to the normal polarity, which makes the toner hard to shift to the next recording medium, thus preventing such inconvenience that the recording medium may be soiled by the toner.

Further, the effect can be more reliably achieved.

Further, the surface of the cleaning roller is hardly soiled by the toner, thus easily cleaning the cleaning roller.

Further, the removal effect of the toner on the intermediate transfer body can be increased.

Further, the removal effect of the toner on the intermediate transfer body can be increased, and the recovery roller is hardly soiled by the toner, thus easily cleaning the recovery roller.

The present document incorporates by reference the entire contents of Japanese priority document, 2000-050741 filed in Japan on Feb. 28, 2000.

Although the invention has been described with respect to aspecific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation apparatus comprising:

an image carrier on which an electrostatic latent image is formed while said image carrier is driven so that its surface moves;

a development device which visualizes the electrostatic latent image as a toner image by toner charged to a normal polarity;

an intermediate transfer body which is driven so that its surface moves;

a primary transfer unit which creates an electric field that shifts the toner charged to the normal polarity from said image carrier towards said intermediate transfer body, and primarily transfers the toner image on said image carrier onto said intermediate transfer body;

a first cleaning device which removes any residual toner existing on the surface of said image carrier after the toner image is primarily transferred to said intermediate transfer body;

a secondary transfer unit which creates an electric field that shifts the toner charged to the normal polarity from said intermediate transfer body towards a recording medium, and secondarily transfers the toner image on said intermediate transfer body onto said recording medium; and a second cleaning device which removes any residual toner existing on the surface of said intermediate transfer body after the toner image is secondarily transferred to said recording medium, said second cleaning device including a cleaning member positioned opposite to the surface of said intermediate transfer body and to which a voltage having a polarity opposite to the normal polarity is applied; and a cleaning unit which removes the toner shifted to said cleaning member from the surface of said intermediate transfer body, wherein an absolute value of the voltage to be applied to said cleaning member is set to a value greater than the absolute value of the voltage applied to said cleaning member at which toner removal efficiency, when said second cleaning device removes any toner not having received secondary transfer action by said secondary transfer unit on said intermediate transfer body, becomes maximum.

2. The image formation apparatus according to claim 1, wherein the absolute value of the voltage to be applied to said cleaning member is 1.5 or more times the absolute value of the voltage applied to said cleaning member at which the toner removal efficiency, when said second cleaning device removes any toner not having received the secondary transfer action by said secondary transfer unit on said intermediate transfer body, becomes maximum.

3. The image formation apparatus according to claim 1, wherein the voltage to be applied to said cleaning member is set so that the absolute value of an average charge amount of toner on said intermediate transfer body, after passing through said second cleaning device without receiving the secondary transfer action by said secondary transfer unit and before reaching a primary transfer region where the primary transfer is performed, becomes ½ to 4 times the absolute value of the average charge amount of the toner before reaching said second cleaning device, and the charge polarity of the toner before reaching said second cleaning device is opposite to that of the toner after passing through said second cleaning device.

4. The image formation apparatus according to claim 1, wherein said cleaning member is formed with a cleaning roller which is rotatably driven, said cleaning unit is formed with a blade which is in contact with the surface of said cleaning roller with pressure to scrape off the toner deposited on the surface of said cleaning roller, and the surface roughness of said cleaning roller is equal to or less than the average diameter of toner particles.

5. The image formation apparatus according to claim 1, wherein said cleaning member is formed with a brush roller which is rotatably driven, and said cleaning unit is formed with a flicker which is in contact with a brush of said brush roller to flick off the toner stuck to said brush.

6. The image formation apparatus according to claim 1, wherein said cleaning member is formed with a brush roller which is rotatably driven, and said cleaning unit has a recovery roller which rotates while being in contact with said brush of said brush roller and electrostatically recovers the toner stuck to said brush; and a blade which scrapes off the toner deposited on the surface of said recovery roller, and the surface roughness of said recovery roller is set to a value equivalent to or less than the average diameter of toner particles.

7. An image formation apparatus comprising:

an image carrier on which an electrostatic latent image is formed while said image carrier is driven so that its surface moves;

a development device for visualizing the electrostatic latent image as a toner image by toner charged to a normal polarity;

an intermediate transfer body which is driven so that its surface moves;

a primary transfer means for creating an electric field that shifts the toner charged to the normal polarity from said image carrier towards said intermediate transfer body, and primarily transfers the toner image on said image carrier onto said intermediate transfer body;

a first cleaning device for removing any residual toner existing on the surface of said image carrier after the toner image is primarily transferred to said intermediate transfer body;

a secondary transfer means for creating an electric field that shifts the toner charged to the normal polarity from said intermediate transfer body towards a recording medium, and secondarily transferring the toner image on said intermediate transfer body onto said recording medium; and a second cleaning device for removing any residual toner existing on the surface of said intermediate transfer body after the toner image is secondarily transferred to said recording medium, said second cleaning device including a cleaning member positioned opposite to the surface of said intermediate transfer body and to which a voltage having a polarity opposite to the normal polarity is applied; and a cleaning means which removes the toner shifted to said cleaning member from the surface of said intermediate transfer body, wherein an absolute value of the voltage to be applied to said cleaning member is set to a value greater than the absolute value of the voltage applied to said cleaning member at which toner removal efficiency, when said second cleaning device removes any toner not having received secondary transfer action by said secondary transfer means on said intermediate transfer body, becomes maximum.

8. The image formation apparatus according to claim 7, wherein the absolute value of the voltage to be applied to said cleaning member is 1.5 or more times the absolute value of the voltage applied to said cleaning member at which the toner removal efficiency, when said second cleaning device removes any toner not having received the secondary transfer action by said secondary transfer means on said intermediate transfer body, becomes maximum.

9. The image formation apparatus according to claim 7, wherein the voltage to be applied to said cleaning member is set so that the absolute value of an average charge amount of toner on said intermediate transfer body, after passing through said second cleaning device without receiving the secondary transfer action by said secondary transfer means and before reaching a primary transfer region where the primary transfer is performed, becomes ½ to 4 times the absolute value of the average charge amount of the toner before reaching said second cleaning device, and the charge polarity of the toner before reaching said second cleaning device is opposite to that of the toner after passing through said second cleaning device.

10. The image formation apparatus according to claim 7, wherein said cleaning member is formed with a cleaning roller which is rotatably driven, said cleaning means is formed with a blade which is in contact with the surface of said cleaning roller with pressure to scrape off the toner deposited on the surface of said cleaning roller, and the surface roughness of said cleaning roller is equal to or less than the average diameter of toner particles.

11. The image formation apparatus according to claim 7, wherein said cleaning member is formed with a brush roller which is rotatably driven, and said cleaning means is formed with a flicker which is in contact with a brush of said brush roller to flick off the toner stuck to said brush.

12. The image formation apparatus according to claim 7, wherein said cleaning member is formed with a brush roller which is rotatably driven, and said cleaning means has a recovery roller which rotates while being in contact with said brush of said brush roller and electrostatically recovers the toner stuck to said brush; and a blade which scrapes off the toner deposited on the surface of said recovery roller, and the surface roughness of said recovery roller is set to a value equivalent to or less than the average diameter of toner particles.

* * * * *